United States Patent [19]

Merchant et al.

[11] Patent Number: 4,539,099

[45] Date of Patent: Sep. 3, 1985

[54] PROCESS FOR THE REMOVAL OF SOLIDS FROM AN OIL

[75] Inventors: Philip Merchant; R. Roger Wunderlich, both of Houston, Tex.

[73] Assignee: Exxon Research & Engineering Co., Florham Park, N.J.

[21] Appl. No.: 652,792

[22] Filed: Sep. 20, 1984

Related U.S. Application Data

[63] Continuation-in-part of Ser. No. 567,257, Dec. 30, 1983, abandoned, which is a continuation of Ser. No. 500,638, Jun. 3, 1983, abandoned.

[51] Int. Cl.[3] ..... C10G 29/00

[52] U.S. Cl. ..... 208/177; 208/180; 208/251 R; 208/291; 208/39

[58] Field of Search ..... 208/177, 251 R, 180, 208/291

[56] References Cited

U.S. PATENT DOCUMENTS

| | | | |
|---|---|---|---|
| 2,609,931 | 9/1952 | Redman et al. | 208/180 |
| 2,756,196 | 7/1956 | Uzzell et al. | 208/291 |
| 3,282,827 | 11/1966 | Corysiak, Jr. | 208/180 |
| 3,450,627 | 6/1969 | Johnson | 208/180 |
| 3,563,885 | 2/1971 | Talbot | 208/180 |
| 4,056,462 | 11/1977 | Li et al. | 208/177 |
| 4,177,134 | 12/1979 | Rhodes et al. | 208/177 |
| 4,250,021 | 2/1981 | Salusinszky | 208/251 R |
| 4,396,498 | 8/1983 | Dente et al. | 208/177 |

*Primary Examiner*—D. E. Gantz
*Assistant Examiner*—Cynthia A. Prezlock
*Attorney, Agent, or Firm*—Roland A. Dexter

[57] ABSTRACT

A process for removing suspended solids particularly difficultly filterable inorganic solids from an oil obtained as a refinery process bottom fraction from both steam and catalytic cracking units (e.g. catalytic cracker bottoms) or from coal conversion processes (e.g. coal tar) by adding to the oil an agglomerating agent comprising an oxyalkylated phenol formaldehyde resin glycol ester whereby said solids are clustered together into readily filterable agglomerates.

9 Claims, No Drawings

PROCESS FOR THE REMOVAL OF SOLIDS FROM AN OIL

Continuation-in-part of Ser. No. 567,257 which was filed on Dec. 30, 1983, now abandoned and which was a continuation of Ser. No. 500,638, filed June 3, 1983 now abandoned which is based on CSTD 8-82.

FIELD OF THE INVENTION

This invention is concerned generally with the removal of suspended solids from an oil. More particularly it relates to a process for producing a solids-reduced hydrocarbon oil in which suspended solids in the oil are agglomerated by adding to the oil a solids-agglomerating agent comprising an oxyalkylated glycol ester and separating the agglomerated solids from the oil.

BACKGROUND OF THE INVENTION

A number of processes in petroleum production and refining, coal conversion and the chemicals industry produce as by-products liquid hydrocarbons containing insoluble solid particles oftentimes in the form of finely divided suspended inorganic solids.

Among the processes which produce liquid hydrocarbons containing appreciable amounts of finely divided suspended solids are steam cracking, catalytic cracking, coal gasification, coke production, and liquification of coal. Steam cracking produces a steam cracking tar which contains insoluble particles of coke generally at a level of 0.001 to 5.25% with the remainder being useful heavy liquid hydrocarbons. Catalytic cracking produces cat cracker bottoms which contain catalyst fines generally at a level of 0.1 to 5 wt.% with the remainder being useful heavy liquid hydrocarbons. Liquefication of coal, such as by the donor solvent technique as described in U.S. Pat. Nos. 4,085,031; 4,253,937; 4,048,054 and 4,045,328, produces a solvent-coal slurry containing insoluble particles. Other liquids from coal are produced in its conversion processes by, for example, in its gasification, coke preparation and other processes involving the pyrolysis of coal. These liquid hydrocarbon streams contain insoluble particles which are desirably removed or reduced in level to allow for their use as a fuel oil or as a feedstock for producing other products.

These liquid hydrocarbon streams oftentimes are routed to a settling tank wherein the solid particles (catalyst fines, coke, inorganic matter, are allowed to gravity settle over an extended period of time whereby an upper layer of substantially particle-free liquid hydrocarbons can be decanted off for product use. Settling of the particles may also be provided for in intermediate or shipping tanks. Unfortunately gravity settling is too slow for the refinery, coal conversion and chemical processes now in use.

Improved techniques which are in use include electrofiltration, filtration and centrifugal separation. The latter two approaches appear to have a low capacity or throughput and a high capital cost. Electrofiltration was handicapped by lack of a regenerable filter media which is stated to have been overcome by the use of hard, smooth spherical glass beads as taught in U.S. Pat. Nos. 3,799,855 and 3,799,856. Unfortunately these techniques are further limited since the typical oil-suspendible solids have average diameters of size below about 100 microns (commonly described in the art as difficultly filterable solids) which size makes satisfactory separation by mechanical separation techniques, including filtration, centrifugation and settling difficult to impossible.

Chemical treatments for oil containing suspended solids have been proposed in the art but, in general, each method suffers from some disadvantage as seen from the prior art discussion of U.S. Pat. No. 4,094,770 wherein the patentee has taught a process for separation suspended unfilterable pacticulate solids from an oil by agglomerating the solids by means of an agglomerating agent comprising a mixture of acetone and 2-butanone.

In U.S. Pat. No. 4,029,567 an agglomerating agent, especially ethanolamine is used to help separate the mineral solids and undissolved coal particles from a solution of coal liquification products.

Gravity settling can also be enhanced by the presence of a surface-active agent as taught in U.S. Pat. No. 2,952,620 wherein solid particles of a silica-alumina cracking catalyst suspended in a heavy gas oil was separated from the oil by treating the suspension with an aqueous solution of a nonionic surface-active agent e.g. a condensation product of diisobutyl phenol and 9–10 moles of ethylene oxide.

Gravity settling can be induced by use of a settling vessel in which the hydrocarbon oil containing the solids is subjected to a temperature gradient (see U.S. Pat. No. 4,048,063).

The dedusting of solids-containing hydrocarbon oils such as these derived from oil shale is accomplished by the use of various surface active agents (see U.S. Pat. No. 4,407,707).

The use of gravity settling additives and techniques have enhanced the settling rate whereby gravity settling became a feasible method for removal of suspended solids requiring little additional capital investment, a mechanically simple operation and readily modified by change of the additive.

It is the object of this invention to enhance the gravity settling rate of suspended solids from hydrocarbon oils by use of an improved agglomeration aid alone or in combination with other additives.

SUMMARY OF THE INVENTION

It has been discovered that the residual hydrocarbon oil from petroleum and coal conversion processes, for example hydrocarbon oils boiling in the range of about 200° C. to 550° C., can be readily reduced in solids preferably inorganic solids content to an oil having less than 500 weight parts per million (WPPM) of filterable solids when admixed with from 25 to 1000, preferably 50 to 250 ppm of a ethoxylated-propoxylated $C_4$–$C_9$ alkyl phenol formaldehyde resin glycol ester of 2,000 to 8,000 $\overline{M}w$ at a temperature of from 35° to 210° C. and allowed to gravity settle for from 0.3 to 10 days.

In accordance with the object of this invention there is provided a process for reducing the ash content of a hydrocarbon oil fraction comprising:

providing a hydrocarbon oil fraction having an ash content greater than 0.02 weight percent and boiling in the range of from about 200° C. to about 550° C.;

treating said cat cracker bottom fraction with at least 10 weight parts per million of an oxyalkylated phenol formaldehyde resin glycol ester; and, recovering a deashed hydrocarbon oil portion having a reduced ash content of filterable solids.

The agglomeration aid is of the class of oxyalkylated phenol formaldehyde resin glycol ester of $\overline{M}w$ ranging from 500 to 50,000, preferably 2,000 to 15,000, optimally 5,000 to 8,000.

Preferred is said ester which is the reaction product of a phenol formaldehyde resin and propylene oxide which product is then reacted with ethylene oxide and finally esterified as by reaction with maleic anhydride or succinic anhydride which collectively is designated herein as a succinate.

DETAILED DESCRIPTION OF THE INVENTION

Within the steam cracking reaction or the catalytic cracking reactor, the liquid hydrocarbon feedstock is subjected to processing conditions of elevated temperature and sometimes elevated pressure to accomplish the desired cracking. The resultant effluent of the reactor is then fractionated into the desired fractions of gases, light liquid hydrocarbons and heavy liquid hydrocarbons, with the heaviest and highest boiling fraction being the steam cracker tar or the cat cracker bottoms which contain the insoluble particles. The coal liquification process involves contacting particulate coal with a hydrogen (e.g. a hydrogen donor solvent) under liquification conditions producing a hydrocarbon stream containing insoluble particles. The hydrocarbon stream can be fractionated to produce gases, light liquid hydrocarbons and heavy liquid hydrocarbons with the heaviest fraction being the bottoms containing the particles. Other liquids from coal are produced by coal conversion process utilizing the pyrolysis of coal.

The gasification of low-BTU coal to supply fuel gas for boilers, kilns and process furnaces was widespread until low cost natural gas became available. The natural gas curtailments in the early 1970s along with the rapid rise in natural gas prices have reawakened interest in industrial coal gasification to provide fuel gas for kiln operations, heat treating furnaces, boilers and industrial heating. The gasification process yields a hot raw producer gas which upon quenching yields varying amounts of coal tar. Since the coal tar has wide industrial applications both for tar-based chemical and pharmaceutical products and for fuels, it is highly desirable to reduce the inorganic ash content of these tars. Similarly in the production of coke, the gas derived from the carbonization of the coal into coke can contain significant amounts of coal tar which is recovered and similarly processed.

Thus, this invention broadly treats any liquid hydrocarbon stream containing insoluble solids or particles particularly fine inorganic solids and liquid hydrocarbons to remove or substantially reduce the solids content of the hydrocarbon oil and is particularly applicable to oils containing finely divided suspended solids, optimally so when these solids can be bonded together by the agglomeration aid bridging through a hydrogen bonding mechanism.

Finely divided oil-suspended solids, in general, are effectively removed from the oil by the process of the invention. Those common properties which engender oil suspendability of these particles, for example particle size, density, charge and the like, are also believed to render them susceptible to effective agglomeration and removal by the present process. Representative solids include mineral ash-forming impurities, coal coke, carbonaceous solids, catalyst and spent shale fines, natural and synthetic mineral oxides, organic and inorganic salts mixtures thereof and the like in particulate form and for the unfilterable solids sized in the average diameter range below about 100 microns, especially below about 60 microns.

Representative suspended-solids-containing oils suitable for use herein include shale oil, coal liquefaction oils as from extraction, hydrogenation, thermal treatment and combinations thereof, coal tars from coke manufacture, tar sand oils, petroleum refinery decant oils such as fractionator bottom oils from a fluid catalytic cracking process bottoms fractions of said oils, resids, mixtures thereof, and the like oils.

These hydrocarbon oils are most effectively treated by the invention when a fraction boiling in the range of 200° C. to 550° C. with a total insoluble solids content greater than about 1,000 WPPM, e.g. from 1,000 to 50,000 WPPM more normally an insoluble solids content in the range of 2,000 to 10,000 WPPM.

The Agglomeration Aid

A prime feature of the present process is the discovery of a unique solids-agglomerating agent. A solids-agglomerating agent, to be useful and effective in this service, must promote essentially complete removal of solids from an oil an at the same time must leave the oil virtually intact. In general, known solvents employed for recovering solids from an oil do not meet the latter requirement. The failure of these solvents is manifest in their inability to effectively solubilize both paraffinic-type hydrocarbons and asphaltene-type hydrocarbons. Of course it must be apparent that the most difficultly filterable solids are the inorganic particles for which the solvent approach is of no value. In addition, an appreciable portion of the oil is usually rejected (a loss to the process of desirable product precursors) in the form of tacky or flocculent solids.

It has been discovered that a oxyalkylated alkyl phenol formaldehyde glycol resin ester of $\overline{M}w$ ranging from 500 to 50,000, preferably 2,000 to 15,000, optimally, from 5,000 to 8,000, when used in admixture with the solids containing hydrocarbon oil in amounts ranging from 10 to 1,000, preferably 25 to 250, ppm based on the weight of said oil markedly enhances the gravity settling of said solids so that in from 0.3 to 10 days the solids content of said oil is reduced to less than about 500 WPPM. Preferred for use as an agglomeration aid is an ethoxylated propoxylated $C_4$–$C_9$ alkyl phenol formaldehyde resin ester of a $C_4$–$C_{10}$ dicarboxylic acid anhydride, e.g. maleic or succinic anyydride. Such a material is commercially available as 454-D (70% active dissolved in heavy aromatic naphtha) sold by Aquaness Chemical Co. Houston, Tex. as a demulsifier for oil field applications.

In the event that the solids-containing hydrocarbon contains from 0.05 to 50 weight percent or greater of water, it is useful to supplement the agglomeration aid with from 0.5 to 5 parts by weight of a water shedding additive for each part by weight of said agglomeration aid. Since the water may provoke foaming silicone defoamants may be also added as well as other nonionic and anionic surfactants. All $\overline{M}w$ given herein are weight average molecular weights as determined by gel permeation chromatography.

Agglomeration Conditions

Agglomeration conditions for use in the process of the invention will vary depending upon such process factors as the type and solids content of the hydrocarbon oil, the size distribution of the solids and the properties of the oil being processed. In general, the most satisfactory process temperature will range from 35° C. to 250° C., preferably from 50° C. to 225° C. and optimally from 75° C. to 210° C. In general the process residence time required to reach the desired ash level of less than 0.05 wt percent will range broadly from 0.3 to 10, more usually 2 to 5, days.

The agglomeration aid and, if desired, the supplemental additives such as a water deshedding aid are introduced into the hydrocarbon oil stream to be treated prior to or at the point at which said stream is introduced into the top of the settling tank. The product of the process is withdrawn from a point intermediate (on the side) while the solids settle by gravity to the bottom of the tank. The flow rates and unit sizings in the process system are adjusted to provide the desired residence time in the settling tank. The settled solids in the settling tank are withdrawn generally as a sludge for direct disposal or further treatment to recover additional hydrocarbon oil.

The following examples are provided to illustrate the embodiments of the invention and are not intended to limit it in any way.

EXAMPLES 1-35

In each of these, hydrocarbon oil bottom fractions (obtained from four different refineries) having suspended solids with the following general physical characteristics were used:

TABLE I

| Physical characteristics | |
|---|---|
| Viscosity cst at 210° F. | 8-10 |
| Ash content, wt % | 0.01-0.02 |
| Coking value (wt %) | 6.5-7.2 |
| Asphaltene (n-heptane insolubles), % | 0.5-1.5 |
| Toluene insolubles (0.35), % | 0.1-0.2 |
| Number average mol. wt. | 250-300 |
| Filterable solids (WPPM) | 1000-50,000 |

The hydrocarbon oil bottom fraction obtained from the refinery was charged into a kilogram glass reactor which was electrically heated and equipped with a mechanical agitator. The 200 ml charge of oil was pretreated by heating to 80° C. prior to admixture with a blend containing the indicated agglomeration aid at a blend treat rate of 500 ppm for the oils from Refineries Nos. 1-3 and at both 100 and 200 ppm for the oil from Refinery No. 4. The treated charge was allowed to agitate for 2 minutes and then settle for 72 hours while holding the temperature at 79° C., thereafter 50 ml was drawn off from the upper region of the reactor and subjected to filtration to determine the filterable solids in weight parts per million (WPPM) according to the following technique.

The 50 ml sample is weighed as is the filter paper (0.8 microns pore size) used for the test. The sample is preheated to 70°-80° C., then mixed with 150 to 200 ml of hot xylene (heated above 55° C.) and the admixture poured into the vacuum filter. The container and filter paper are fully rinsed with hot xylene and thereafter with heptane. The now fully rinsed paper is dried at 82° C. for 30 minutes and then placed in a desideator for 30 minutes. The weight of the solids found on the filter paper provides the means for measuring the weight parts per million (WPPM) of filterable solids of the original sample.

The samples obtained from four different refineries and treated according to the process of this invention are set forth in Table II with nonenhanced, i.e. untreated, samples in WPPM shown for reference points.

TABLE II

| Examples | Agglomeration Aid Added | Ash Content (WPPM) of Hydrocarbon Oil Bottom Fraction From Refinery No. 1 | No. 2 | No. 3 | No. 4 | |
|---|---|---|---|---|---|---|
| 1-9 | none | 264 | 959 | 1478 | 345 | |
| | | 224 | 1204 | 1531 | 418 | |
| | | | | | 384 (100 ppm) | (200 ppm) |
| 9-23 | Blend Q[1] | 140 | 98 | 245 | 258 | 271 |
| | | 135 | 161 | 220 | 304 | 150 |
| | | | | 209 | 159 | 115 |
| | | | | 325 | | |
| | | | | 203 | | |
| 24-29 | Blend R[2] | 134 | 208 | 333 | | |
| | | 151 | 162 | 322 | | |
| 30-35 | Blend S[3] | 153 | 316 | 373 | | |
| | | 257 | 216 | 267 | | |

[1]Blend Q is a heavy aromatic naphtha (HAN) solution of 26.32 wt % of 454-D (70% active in heavy aromatic naphtha) purchased from Aquaness Chemical Co. of Houston, Texas and 1 wt. % of a nonylphenol formaldehyde resin of 220 $\overline{M}w$ ethoxylated with 10 moles ethylene oxide. The 454-D shows $\overline{M}w$ components of 8,000; 5,000; 3,000; and 2,300 at a ratio of 1:1:0.5:1, respectively.

[2]Blend R is a HAN solution of 26.32 wt. % of 2437-D (80-90% active in aromatic solvents) purchased from Aquaness Chemical Co. of Houston, Texas. 2437-D believed to be a blend of oxyalkylated phenol formaldehyde resin glycol esters having weight average molecular weight components of about 10,000 (70%), 5,500 (15%) and 2,800 (15%).

[3]Blend S is a HAN solution of 26.32 wt. % of 2167-D (70-80% active in solvents) purchased from Aquaness Chemical Co. of Houston, Texas. 2167-D is believed to be a blend of oxyalkylated phenol formaldehyde resin glycol esters having $\overline{M}w$ components of: 27,000 (20%); 15,000 (40%); and 6,500 (40%).

EXAMPLES 36-49

In these Examples coal tar samples from three different mines were processed according to this invention and evaluated by comparison with non-enhanced, i.e. untreated, samples in WPPM according to the following procedure.

Each coal tar sample was charged into a kilogram glass reactor which was electrically heated and equipped with a mechanical agitator. Each 200 ml charge of coal tar pretreated by heating to 80° C. prior to admixture with a blend containing the indicated agglomeration aid at a blend treat rates of 27 ppm and 135 ppm. Each treated charge was allowed to agitate for 2 minutes and then settle for 72 hours while holding the temperature at 79° C., thereafter 50 ml was drawn off from the upper region of the reactor and subjected to filtration to determine the filterable solids in weight parts per million (WPPM) according to the hot xylene-filtration technique discussed and used in Examples 1-35.

The weight of the solids found on each filter paper provided the means for measuring the weight parts per million (WPPM) of filterable solids of the original sample.

The coal tar samples obtained from three different coal mines had the following typical analyses.

TABLE III

| | Coal Tar Samples A | B | C |
|---|---|---|---|
| Flash Point °C. | 102 | 111 | 93 |
| Pour Point °C. | 32 | 35 | 16 |
| Viscosity at 50° C. Kinematic (cs) | 86.83 | 48.94 | 430.7 |

TABLE III-continued

| | Coal Tar Samples | | |
|---|---|---|---|
| | A | B | C |
| % Hydrogen | 9.23 | 7.48 | 6.40 |
| % Carbon | 77.22 | 74.09 | 69.83 |
| % Nitrogen | 0.43 | 1.15 | 1.16 |
| % Moisture | 9.31 | 10.5 | 12.07 |
| % Ash | 0.02 | 0.09 | 0.28 |

These 3 samples were treated according to the process of this invention with Blend $Q_1$ (Blend Q modified by the presence of 11.7 wt.% of water shedding additives [oxyalkylated resins] and 0.5 wt.%) and the results are set forth in Table IV as Examples 37–39, 41–44 and 46–49 along with comparative results from non-enhanced, i.e. untreated, samples as Examples 36, 40 and 45 in WPPM shown for reference points.

TABLE IV

| Exam. | Additive | Rate PPM | Vol % $H_2O$ Add to Coal Tar Sample | Treated Sample Solids Content WPPM A | B | C |
|---|---|---|---|---|---|---|
| 36 | None | — | 0 | 14,608 | | |
| 37 | $Q_1$ | 100 | 0 | 2,313 | | |
| 38 | $Q_1$ | 100 | 5 | 2,286 | | |
| 39 | $Q_1$ | 500 | 0 | 8,024 | | |
| 39 | $Q_1$ | 500 | 5 | 7,787 | | |
| 40 | None | — | 0 | | 9,633 | |
| 41 | $Q_1$ | 100 | 0 | | 9,500 | |
| 42 | $Q_1$ | 100 | 5 | | 7,990 | |
| 43 | $Q_1$ | 500 | 0 | | 5,106 | |
| 44 | $Q_1$ | 500 | 5 | | 4,026 | |
| 45 | None | 0 | 0 | | | 136,000 |
| 46 | $Q_1$ | 100 | 0 | | | — |
| 47 | $Q_1$ | 100 | 5 | | | 108,400 |
| 48 | $Q_1$ | 500 | 0 | | | 108,000 |
| 49 | $Q_1$ | 500 | 5 | | | 122,560 |

The data recorded in Table III clearly shows the marked reduction in filterable solids content when the process of the invention is followed but with a hydrocarbon liquid of a Kinematic viscosity in centipoises (cs) at 50° C. of no greater than 330, preferably less than 300, and optimally less than 200. Since the coal tar samples already contained from 9 to 12% water no advantage resulted from adding 5% more water. It appears that the agglomeration process is preferably carried on the liquid hydrocarbon containing 2 to 30, optimally 5 to 15, weight percent water based on the weight of the liquid hydrocarbon.

The invention in its broader aspect is not limited to the specific details shown and described and departures may be made from such details without departing from the principles of the invention and without sacrificing its chief advantages.

What is claimed is:

1. A process for reducing the particulate solids content of a hydrocarbon oil fraction comprising:

providing a hydrocarbon oil fraction boiling in the range of from about 200° C. to about 550° C.;

treating said hydrocarbon oil fraction with an agglomeration aid wherein the resulting mixture contains from 10 to 1000 weight parts per million of said aid based on the total weight of said mixture, said agglomeration aid comprising oxyalkylated phenol formaldehyde resin glycol ester of $\overline{M}w$ ranging from 500 to 50,000; and, recovering a hydrocarbon oil bottoms portion having a reduced content of filterable solids.

2. The process of claim 1 wherein said bottom fraction had at least 1000 weight parts per million (WPPM) of filterable solids and said recovered portion had less than 500 WPPM.

3. The process of claim 1 wherein said aid is an ethoxylated-propoxylated $C_4$–$C_9$ alkyl phenol formaldehyde resin glycol ester of a $\overline{M}w$ ranging from 2,000 to 15,000.

4. The process of claim 1 wherein said treating is at a temperature of from 35° C. to 250° C. and for residence times ranging from 0.3 to 10 days.

5. The process of claim 1 wherein said fraction is a refinery bottoms fraction.

6. The process of claim 1 wherein said fraction is coal tar having a Kinematic viscosity at 50° C. of no more than 330 centistokes.

7. The process of claim 2 wherein said aid is a succinate and present in said mixture in from 10 to 250 ppm.

8. The process of claim 5 wherein said solids are predominantly catalytic cracker fines having a diameter of less than 100 microns.

9. The process of claim 6 wherein said solids are substantially all inorganic solids.

* * * * *